United States Patent [19]

Wallander

[11] 4,413,554

[45] Nov. 8, 1983

[54] REFUSE COMPACTING DEVICE

[75] Inventor: Carl-Otto Wallander, Västra Frölunda, Sweden

[73] Assignee: Hydropress Wallander & Co. AB, Mölndal, Sweden

[21] Appl. No.: 373,058

[22] Filed: Apr. 29, 1982

[51] Int. Cl.[3] ..... B30B 15/16

[52] U.S. Cl. ..... 100/43; 100/112; 100/127; 100/131; 100/192; 100/909

[58] Field of Search ..... 100/43, 104, 116, 126, 100/127, 131, 112, 147, 192, 909

[56] References Cited

U.S. PATENT DOCUMENTS

| | | | |
|---|---|---|---|
| 2,422,895 | 6/1947 | Habenicht | 100/127 X |
| 3,121,387 | 2/1964 | Fuhrwerk | 100/43 |
| 3,179,040 | 4/1965 | Seltzer | 100/43 |
| 3,467,000 | 9/1969 | Seltzer | 100/43 |
| 3,789,752 | 2/1974 | Wirz | 100/192 X |

FOREIGN PATENT DOCUMENTS 2429394 8/1976 Fed. Rep. of Germany .

*Primary Examiner*—Billy J. Wilhite
*Attorney, Agent, or Firm*—Cantor and Lessler

[57] ABSTRACT

A device for compacting and dewatering moist refuse comprises a tube and a piston reciprocable therein. Varying consistency of the refuse matter will require a varying resistance to the compacting action of the piston. A throttling device within the tube comprises a number of plates which are swingable about an axis arranged perpendicularly to the tube, and are actuable so as to occupy a position practically level with the wall of the tube, or to a position in which they extend into the tube, respectively. The piston is operated by a double acting hydraulic ram, and the plates are operated by a further hydraulic ram. Both rams are connected to a source of pressure fluid, and are interconnected so the power stroke end of the further ram communicates with the return flow end of the piston ram, and vice versa. Two oppositely directed non-return valves are fitted in parallel in the conduit connecting the power stroke end of the further ram with the return flow end of the piston ram.

3 Claims, 5 Drawing Figures

REFUSE COMPACTING DEVICE

BACKGROUND OF THE INVENTION

Various types of compacting devices are used to handle moist refuse material. Basically such a device comprises an elongate tube, in one end of which a piston is reciprocable adjacent to an inlet. The refuse material is fed towards the opposite end of the tube, and is simultaneously compacted and dewatered.

Variations in the consistency and moisture retaining capacity of the material will often cause difficulties, as the function of the device is based upon the friction of the material against the wall of the tube causing a certain resistance. If the material is smooth and fatty it may slide through the tube without being dewatered to a satisfactory degree. If, on the other hand, the material is too coarse and gritty it may clog the tube.

The aim of the present invention is to propose a device, which automatically adjusts the resistance to flow, which, in turn, will determine the power required for forcing the piston into the tube. Various types of resistance members have been proposed to meet this problem, but have not operated satisfactorily.

SUMMARY OF THE INVENTION

A compacting device according to the invention comprises a double acting hydraulic ram for operating the piston, and a second hydraulic ram for actuating the resistance varying member. The invention is characterized in that the throttling member comprises at least one plate, which is pivotable about an axis arranged perpendicularly to the tube, and adapted to be introduced edgewise into the tube, to be displaced between two positions, one which leaves the cross section of the tube substantially uninfluenced, and one which means a considerable restriction of the cross sectional area, one end of said second hydraulic ram being connected with the power side of the first hydraulic ram, while its opposite side is connected to the return stroke side of the first hydraulic ram by way of two oppositely directed non-return flow valves.

The non-return valve opening away from the second hydraulic ram is preferably biased by a load to just below the switch-over pressure at the end of the power stroke of the first hydraulic ram.

The throttling member preferably comprises a number of parallel plates operating between fixed bars and being pivotable about an axis at the edge of the plates adjacent to the inlet end of the tube.

DETAILED DESCRIPTION

Figure 1:
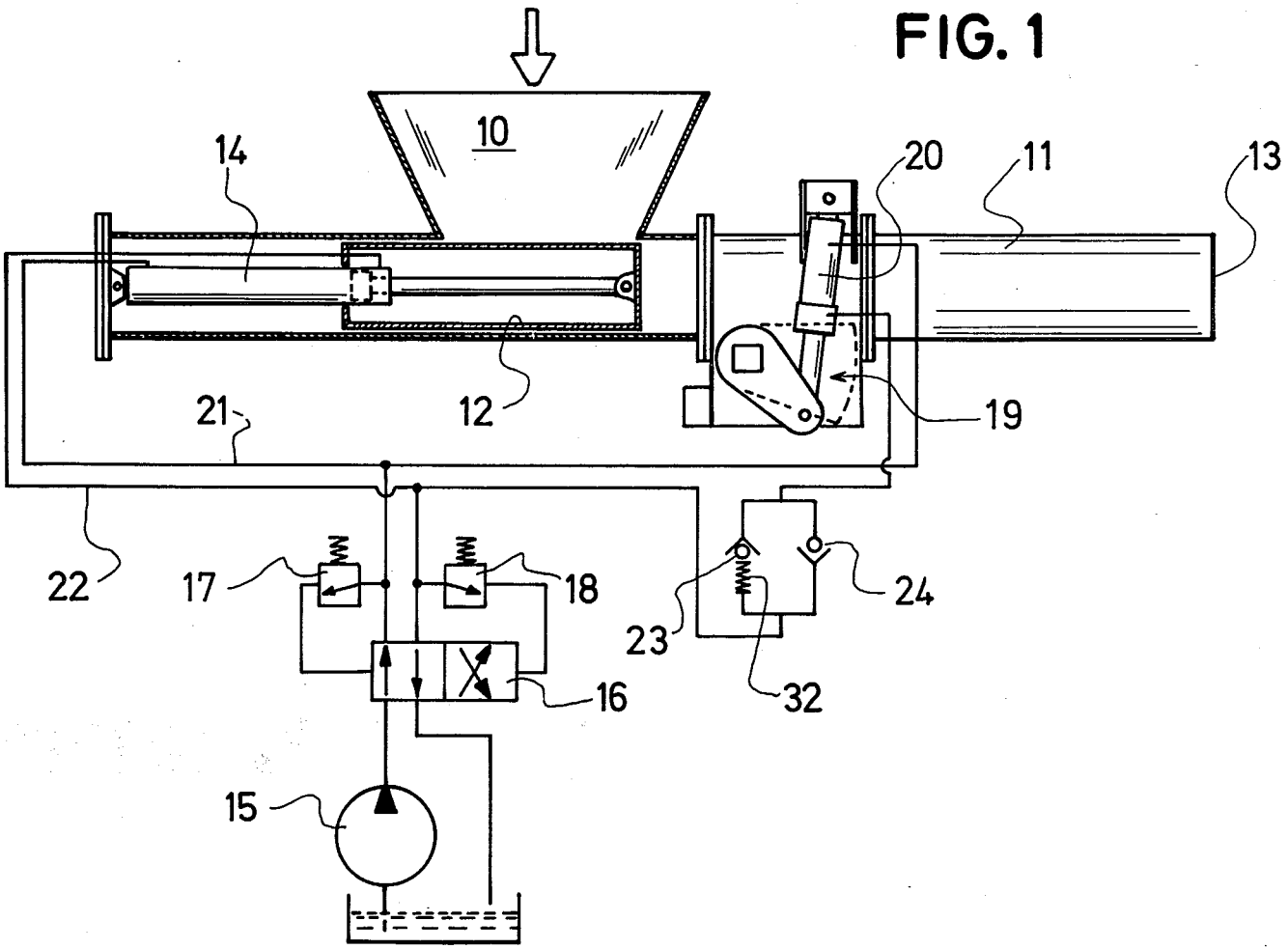
FIG. 1 schematically shows a compacting device provided with a throttling member according to the invention, FIG. 2, on a larger scale, shows a portion of the tube, where the throttling member is located.
Figure 2:
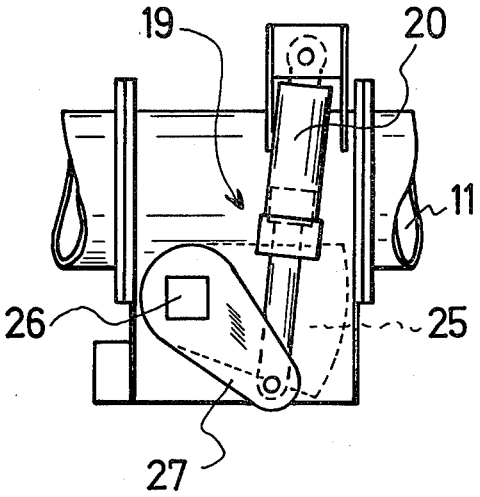
Figure 3:
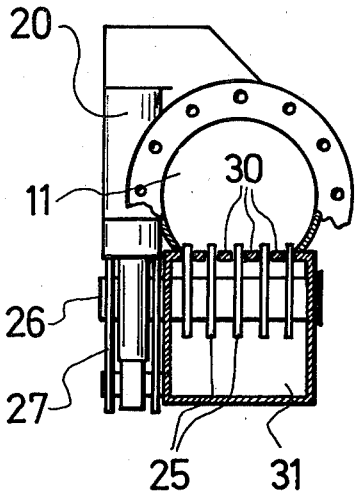
FIG. 3 shows an end view, partly in section of the portion shown in FIG. 2, and FIGS. 4 and 5 show cut-up views of the portion of FIG. 2 with a throttling plate in rest position, and in fully restricting position, respectively.

There are a number of refuse material compactors, and FIG. 1 does only show the main components, essential to the function.

The refuse is continuously or intermittently, fed into a hopper 10, and is by means of a piston 12 forced through a tube 11 towards the mouth 13 of the tube. The tube 11 has a length which offers a resistance to progress of the material, so a de-watering thereof occurs during the passage towards the mouth of the tube. For the sake of simplicity the means for draining and collecting the water squezed out of the material are not shown in FIG. 1.

The piston 12 is operated by means of a double acting hydraulic ram 14, which is supplied with pressure fluid from a pump 15. A change-over valve 16, of arbitrary known design determines the direction of movement of the piston, and two guide valves 17, 18 govern the change-over valve 16 acted upon by the fluid pressure which rises to a maximum value when the piston 12 has reached either of its end positions.

The resistance offered by the material within the tube 11 may vary, as mentioned above, and it may therefore be interesting to be able to control the resistance. In the portion of the tube 11 adjacent to the inlet hopper 10, there is a throttling member, generally denoted by 19, and actuated by a second hydraulic ram 20.

One end of the second ram 20 is connected to a conduit 21 serving the power stroke side of the first ram 14. The opposite side of the second ram is connected to a conduit 22 serving the return stroke side of the first ram by way of two non-return valves 23, 24, of which the former opens away from the valve, and the other opens towards the valve. The throttling member 19 will be brought to a braking position when conduit 22 is pressurized, and will be retracted when the pressure in conduit 21 increases during a power stroke of piston 12.

The intention is that the throttling member 19 shall automatically alter its character in response to the occasional resistance within the tube 11, which will determine the fluid pressure required to force the piston 12 inwards. The throttling member includes components in the form of flaps or plates, which will alter the cross sectional area within the tube 11 to varying degrees.

FIGS. 2–5 show, on a larger scale, a preferred embodiment of the throttling member 19. This comprises a number of plates 25, which are mounted upon a shaft 26 arranged perpendicularly to the longitudinal direction of the tube 11 and is connected to a lever 27, which, in turn, is connected to the piston rod of the second ram 20.

The shaft 26 is located at the end of the tube adjacent to the inlet 10, and the plates 25 will be directed away therefrom.

Figure 4:
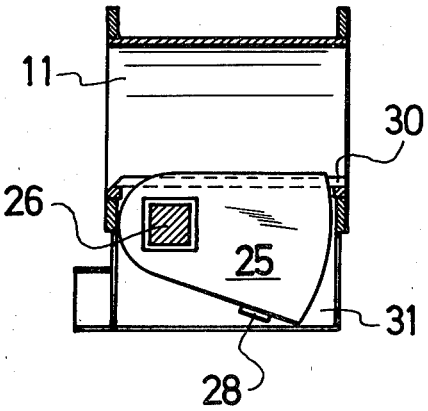
Figure 5:
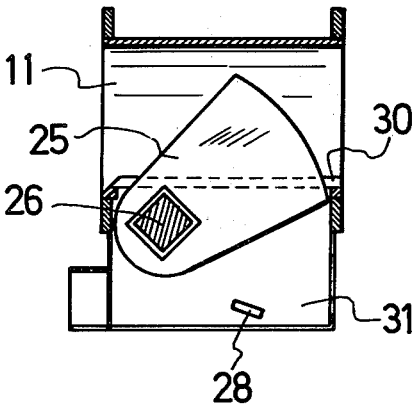

In FIG. 4 the plate 25 rests in a swung-down position upon a projection 28, and its upper edge extends substantially horizontally, and level with the inside of the wall of the tube. In this position the plate will offer practically no resistance to flow. In FIG. 5 the plate has been swung to its top position, where it offers a considerable resistance to flow for the material, which will have to pass between the plates and above their upper corners.

Bars 30 are fitted between the plates to form a grate-like pattern, through which the plates 25 are swung upwards and downwards. Here a considerable part of the dewatering occurs, and the movements of the plates ensure a cleaning of the grate. Below the same there is a through 31 for collecting the moisture squeeze out of the material.

The device operates in the following manner. After a completed power stroke of the piston 12 (during which the piston in the second ram 20 may have been forced to its lower position) change-over valve 16 is shifted so pressure fluid is supplied by way of conduit 22 and piston 12 starts on its return stroke. Simultaneously pressure fluid will flow through non-return valve 24 to the lower side of the piston of the second ram 20, so lever 27 is swung upwards.

FIG. 1 shows the position of the components at the end of a pressure stroke of the piston 12, and with the plates 25 in swung down position. During the return stroke of the piston 12 the plates 25 will be swung upwards, so the following power stroke will start with the plates in their utmost braking position.

Non-return valve 24 is of conventional design for the pressures occurring in the system, while non-return valve 23 is biased by a strong spring 32, the acting force of which may be adjusted.

The efficient area at the lowerface of the piston in ram 20 will be reduced due to the piston rod, and it is essential that the biasing pressure at non-return valve 23 be adjusted so it is slightly lower than the switch-over pressure at the end of the power stroke of the first ram and acting upon governing valve 18.

The power stroke of the piston 12 will thus start while the plates 25 are swung to their uppermost position and the chamber below the piston in the second ram 20 is filled with fluid. If the material is soft it will pass between and over the plates. The upper face of the piston in the second ram 20 will be subjected to the pressure in conduit 21, but non-return valve 23 will prevent expulsion from the lower side of ram 20. If the material is more coarse the pressure in conduit 21 will rise, and finally the combined action of the increased pressure at the upper face of the second ram piston and the pressure against the plates 25—which by way of lever 27 and the piston rod tend to pull the piston in the second ram 20 downwards—will be sufficient strong to move the piston downwards, which opens non-return valve 23. This movement will only occur until a balancing between the pressure against the plates and the biasing force upon the non-return valve is attained, and the plates have been brought to a new, restricting position.

When the main piston 12 has terminated its power stroke, the pressure in conduit 21 rises towards the switch-over pressure, and the second ram 20 will bring the plates to their lowermost position (shown in FIG. 4) just before the switch-over occurs. In this manner an efficient cleaning between the bars 30 is brought about for each power stroke.

During the return stroke of the piston 12 the plates 25 will be swung upwards again, in the manner described above. As the plates are directed away from the inlet they will prevent an expansion backwards of the compressed material during the return stroke of the main piston.

The embodiment above described and shown in the drawings is an example only of the invention, the details of which may be varied in many ways within the scope of the appended claims. The number and the shape of the plates may be varied in different ways to suit local demands, and the hydraulic system may be designed and augmented in many ways, well known to a man skilled in the art.

What I claim is:

1. A device for compacting refuse material and of the type comprising a piston reciprocable within a tube and being driven by a first double-acting hydraulic ram having a first end connected to a source of pressure fluid ensuring a power stroke, and a second end connected to a return flow conduit, the improvement of at least one throttling plate member swingable about an axis located perpendicularly to said tube so as to be introducable edgewise thereinto, a further hydraulic ram for swinging said at least one plate between a first position which leaves the cross section of said tube substantially unrestricted and a second position obtainable during a power stroke of said further ram, where said plate imparts a considerable restriction of said cross section, said further hydraulic ram having a power stroke end and a return flow end, a first conduit for connecting the power stroke end of said further ram with the return flow end of said first ram, a second conduit for connecting the return flow end of said further ram with the power stroke end of said first ram, and two oppositely directed non-return valves fitted in parallel in said first conduit.

2. The compacting device according to claim 1, wherein said non-return valve opening away from said second hydraulic ram is biased by a load to just below the switch-over pressure at the end of the power stroke of said first hydraulic ram.

3. The compacting device according to either of claims 1 or 2, wherein a number of parallel plates are operating between fixed bars in said tubes and are pivotable about an axis located at the edge of said plates turned towards said piston.

* * * * *